US010377526B2

(12) United States Patent
Martínez Colorado et al.

(10) Patent No.: US 10,377,526 B2
(45) Date of Patent: Aug. 13, 2019

(54) DEVICE AND METHOD FOR CONNECTING PARTS OF A CRATE

(71) Applicant: OBEIKAN MDF ESPAÑA, S.L., Canet d'en Berenguer (Valencia) (ES)

(72) Inventors: Salvador Martínez Colorado, Canet d/en Berenguer (ES); Manuel Blay Orenga, Canet d/en Berenguer (ES); Javier Ramón García Aranda, Canet d/en Berenguer (ES)

(73) Assignee: OBEIKAN MDF ESPANA, S.L., Canet d/en Berenguer (Valencia) (ES)

( * ) Notice: Subject to any disclaimer, the term of this patent is extended or adjusted under 35 U.S.C. 154(b) by 584 days.

(21) Appl. No.: 14/916,369

(22) PCT Filed: Aug. 7, 2014

(86) PCT No.: PCT/ES2014/070645
§ 371 (c)(1),
(2) Date: Mar. 3, 2016

(87) PCT Pub. No.: WO2015/033005
PCT Pub. Date: Mar. 12, 2015

(65) Prior Publication Data

US 2016/0194108 A1 Jul. 7, 2016

(30) Foreign Application Priority Data

Sep. 4, 2013 (ES) ..... 201331304

(51) Int. Cl.
*B65D 6/24* (2006.01)
*B65D 6/00* (2006.01)
*B65D 6/26* (2006.01)

(52) U.S. Cl.
CPC ..... *B65D 11/1873* (2013.01); *B65D 13/04* (2013.01); *B65D 7/30* (2013.01); *B65D 9/22* (2013.01)

(58) Field of Classification Search
CPC . B65D 11/1873; B65D 7/30; Y10T 29/49826; Y10T 29/53
(Continued)

(56) References Cited

U.S. PATENT DOCUMENTS

2007/0075043 A1 4/2007 Riogonzalez et al.
2007/0261219 A1 11/2007 Koch et al.
(Continued)

FOREIGN PATENT DOCUMENTS

ES 2 322 075 6/2009
ES 1 072 454 5/2010
(Continued)

OTHER PUBLICATIONS

English Translation Martinez ES1073141U Oct. 28, 2010.*
International Search Report dated Oct. 13, 2014 in International Application No. PCT/ES2014/070645.

*Primary Examiner* — Jason L Vaughan
*Assistant Examiner* — Amanda Kreiling
(74) *Attorney, Agent, or Firm* — Wenderoth, Lind & Ponack, L.L.P.

(57) ABSTRACT

A device for connecting parts of a crate includes a female sheet including a slot and a peripheral surface; and a male sheet including a tab and a peripheral surface, the male sheet being coupled to the female sheet by the tab. The tab includes a stop element in an upper part of the male sheet closest to the peripheral surface of the female sheet, an upper surface of the tab extending upward, and a front surface of the tab extending downward and being completed with a lower surface connected to an inclined guiding surface.

7 Claims, 2 Drawing Sheets

(58) Field of Classification Search
USPC ..... 403/97, 116
See application file for complete search history.

(56) References Cited

U.S. PATENT DOCUMENTS

| | | | | |
|---|---|---|---|---|
| 2013/0062241 | A1* | 3/2013 | Blay Orenga ..... | B65D 9/12<br>206/509 |
| 2013/0146606 | A1 | 6/2013 | Blay Orenga et al. | |

FOREIGN PATENT DOCUMENTS

| | | | | |
|---|---|---|---|---|
| ES | 1 072 938 | | 10/2010 | |
| ES | 1 073 141 | | 10/2010 | |
| ES | 1073141 U | * | 10/2010 | ..... B65D 11/1873 |
| WO | 2005/117796 | | 12/2005 | |

* cited by examiner

DEVICE AND METHOD FOR CONNECTING PARTS OF A CRATE

OBJECT OF THE INVENTION

The object of the present invention refers to a novel device for connecting parts of a crate and a method thereof, applicable to the transport and logistics industry.

The invention includes a novel connection between parts of a crate and a method thereof, which alloys for improving the coupling and simplifying the assembly of this kind of crate-like containers, made up by rigid components attachable to each other.

BACKGROUND OF THE INVENTION

The different kinds of attachments between crates or containers are well known in the state of the art, according to which the side walls and bases of crates may be attached to each other by means of joints or couplings, There are many different types of these couplings, more complex or simple, also varying their complexity or simplicity of assembly, thus resulting in more or less resistant containers.

Said couplings may adopt different configurations known in the art. A mono-material container with fastening means that prevent the use of staples, nails or some kind of adhesive for connecting its sheets is known from document ES 2 322 075 T3. A container whose bottom, side walls and lids have different configurations and are connected by simple movements is known from document ES 1 073 141 U.

The transport and logistics industry continuously demands effective solutions to improve the simplicity to attach parts of a crate for its easy and comfortable transport, saving space, and to improve speediness when connecting said parts of a crate by automated processes. No documents have been found in the state of the art describing a connection and a connection method, which allows the simple coupling between parts of a crate, by means of two simple movements, the connection being interchangeably between its side walls or bases.

DESCRIPTION OF THE INVENTION

To achieve the goals of simple coupling by means of two movements of simple path, and to resolve the previously mentioned inconveniences, the invention has developed a novel device and method for connecting parts of a crate comprising a female sheet which, in turn, comprises a slot and a peripheral surface; and a male sheet which, in turn, comprises a peripheral surface, said male sheet being coupled to the female sheet by means of a tab.

The tab of the male sheet of the device for connecting parts of a crate comprises a first stop element in the upper part thereof closest to the peripheral surface, said stop element extending upwards by means of an upper surface, said upper surface extending downwards by means of a front surface until it connects with a guiding surface via a lower surface.

The guiding surface of the tab comprises an inclination ranging between 0° and 30° in an embodiment of the invention, and an inclination ranging between 31° and 60° in another embodiment of the invention. The front surface has the same width as the peripheral surface of the male sheet, and a shorter length than the length of the slot of the female sheet.

The invention also comprises a method for connecting parts of a crate, which comprises a first stage with a first movement in a direction perpendicular to an external side of the female sheet and getting close to the peripheral surface of the male sheet, until said peripheral surface of the male sheet is faced and in contact with the female sheet, thus leaving the first stop element of the male sheet at a certain distance from the upper surface of the slot of the female sheet.

The method comprises a second movement parallel to the external side of the female sheet and oriented towards the first stop element and second stop element, thus the upper horizontal surface of the slot face and the first stop element of the male sheet, and the lower surface of the guiding surface face and the second stop element of the female sheet are also faced and coincident.

In an embodiment of the invention, the second movement of the second stage is carried out by means of a mechanical action. In another embodiment of the invention, the second movement of the second stage is applied by means of a guiding action resulting from the geometry of the tab.

DESCRIPTION OF THE DRAWINGS

To complete the description and in order to give a better understanding of the characteristics of the invention, this descriptive report is accompanied by a series of drawings that are an integral part of the report, wherein, for illustration purposes and without limitation, the following has been represented.

Figure 1:
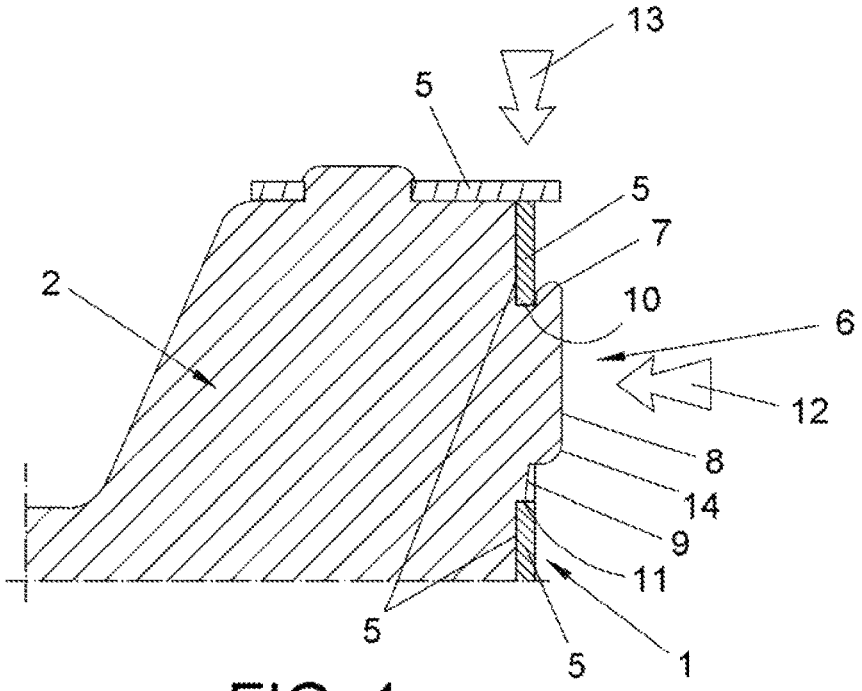
FIG. 1 is an elevation view of an embodiment of the device for connecting parts of a crate, object of the invention, where the coupling between the two parts of a crate can be appreciated.

A list of the different components that have been represented in the drawings and that comprise the invention is detailed below:

1. Female sheet
2. Male sheet
3. External side
4. Slot
5. Peripheral surface
6. Tab
7. Upper surface
8. Front surface
9. Guiding surface
10. First stop element
11. Second stop element
12. First movement
13. Second movement
14. Lower surface

DETAILED DESCRIPTION OF THE INVENTION

Figure 2:
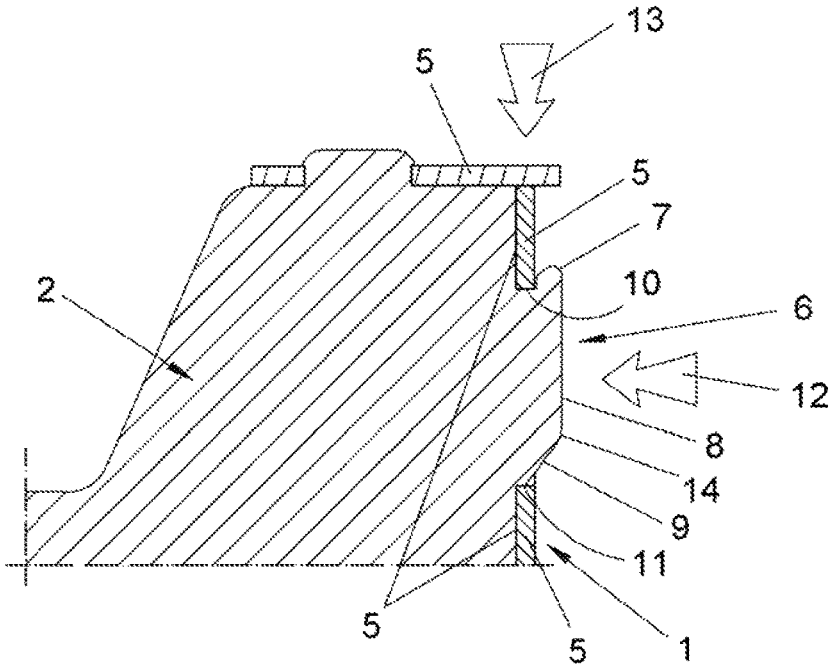
FIG. 2 is an elevation view of an embodiment of the device for connecting parts of a crate, object of the invention, where the coupling between the two parts of a crate can be appreciated.
Figure 3:
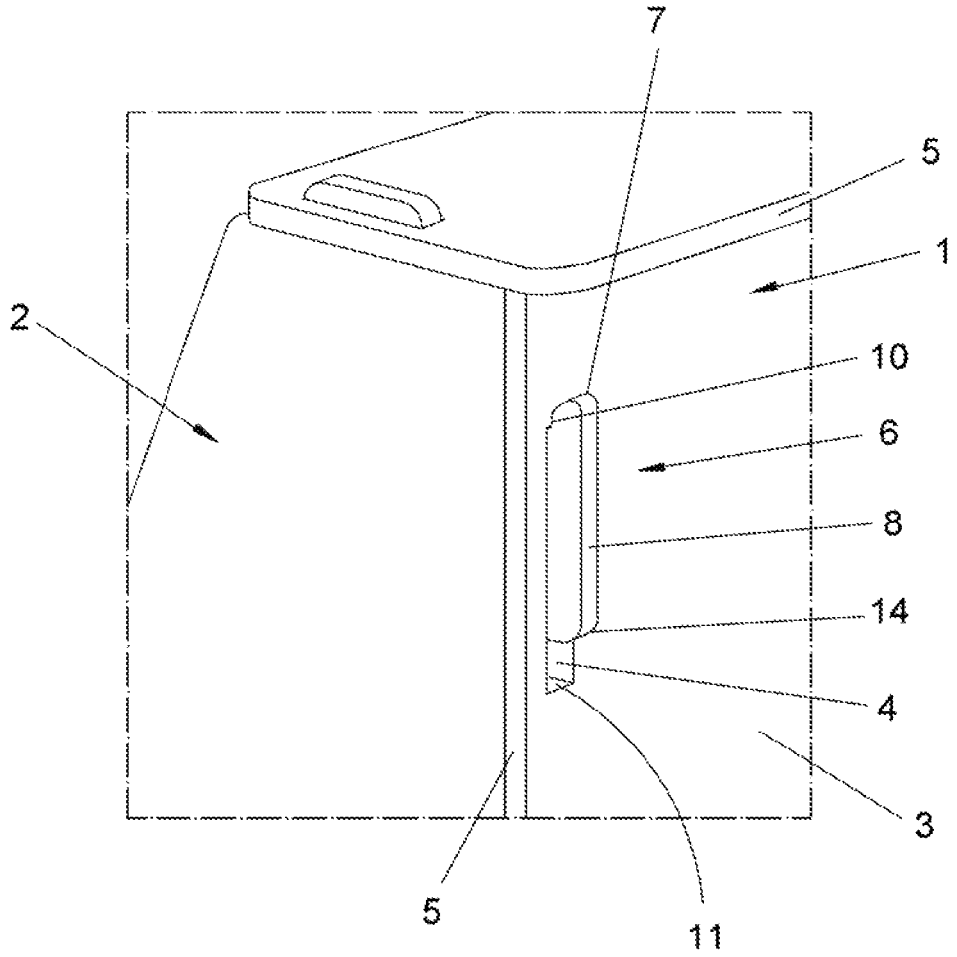
FIG. 3 is a general perspective view of the device for connecting parts of a crate, object of the invention, where the coupling between the two parts of a crate may be appreciated.

In view of the above-said and with reference to the numbering adopted in the figures, FIGS. 1 to 3 depict the preferred embodiments of the lamp ring, which is the object of the invention, FIG. 1 represents an elevation view of the device for connecting parts of a crate, object of the invention. The connecting device is composed of two parts coupleable with each other, a female sheet (1) and a male sheet (2), which may interchangeably act as base, lid or side walls of a crate in different embodiments of the invention. Said female sheets (1) and male sheets (2) may adopt different geometries in different embodiments of the invention, a preferred embodiment being that wherein a rectangular prismatic shape is adopted, its thickness being defined by a peripheral surface (5). Said thickness defined by a peripheral surface (5) may change depending on the consistency the definitive crate is meant to have.

In FIG. 3, the geometry of a female sheet (1) may be better observed, which in the proximity of its peripheral surface (5) comprises at least one slot (4). Said slot (4) creates a through hole in said female sheet (1), the hole being the prismatic-shaped slot (4), for the coupling with a tab (6) belonging to the male sheet (2), Said sheet (2) comprises a second stop element (11) in its lower horizontal surface, whereon a guiding surface (9) of the tab (6) is supported for the appropriate coupling of the sheets.

In FIGS. 1 and 2, the geometry of two embodiments of the male sheet (2) can be better observed. In the peripheral surface (5), the tab (6) extends for it to be coupled in the slot (4) of the female sheet (1). Said tab (6) comprises in its upper part closest to the peripheral surface (5) a first stop element (10) of rectangular shape, which is coupled in the upper surface of the slot (4) of the female sheet (1). An upper surface (7) of the tab (6) extends upwards following the first stop (10), said upper surface (7) describes an upward chamfer, a horizontal surface and another downward chamfer. Subsequently, a front surface (8) of the same width of the peripheral surface (5) of the male sheet (2) and of shorter length than the length of the slot (4) of the female sheet (1) is extended. Finally, in this embodiment, the lowest part of the front surface (8) is completed with a round-shaped lower surface (14). Said interior lower surface (14) extends up to a guiding surface (9), which is inclined ranging between 0° and 30° until it fits with the second stop element (11) of the female sheet (1).

In an embodiment of the invention the guiding surface (9) starts from the lower surface (14) with an inclination ranging between 31° and 60°, as can be observed in FIG. 2. In this embodiment of the invention, the lower surface (14) comprises a circular chamfer.

The invention is characterized by a coupling between the male sheet (2) and the female sheet (1) by means of two simple-path movement directions, without changes in direction. In a first movement (12) perpendicular to the external side (3) of the female sheet (1), the slot (4) of the female sheet (1) and the tab (6) of the male sheet (2) are placed facing each other. Said elements are placed in such a way that the first stop element (10) faces the upper surface (7) of the tab (6). Then, the first movement (12) begins, in perpendicular direction to the external side (3) of the female sheet (1) and oriented towards the peripheral surface (5) of the male sheet (2), until said peripheral surface (5) is faced and in contact with the female sheet (1). In this manner, the first stop element (10) of the male sheet (2) is faced at certain distance from the upper surface of the slot (4) of the female sheet (1).

In a second movement (13) in parallel direction to the external side (3) of the female sheet (1), and oriented towards the first stop element (10) and the second stop element (11), the upper horizontal surface of the slot (4) is made to face and coincide with the first stop element (10) of the male sheet (2). Likewise, the lower surface of the guiding surface (9) is made to face and coincide with the second stop element (11) of the female sheet (1), This second movement (13) can be applied by means of a mechanical action in an embodiment of the invention. In another embodiment of the invention, this second movement (13) is applied by means of a guiding action resulting from the geometry of the tab (6). Thus, the tab (6) is perfectly fit in the slot (4), as it may be observed in FIG. 3.

The invention is characterized in that said connection may be carried out between two parts of a crate, either a lid or its side sheets or its base.

The present invention is not limited by the embodiments disclosed herein, Other embodiments can be made by those skilled in the art following the present description in consequence, the scope of the invention is defined by the following claims.

The invention claimed is:

1. A device for connecting parts of a crate, the device comprising:

a female sheet comprising a slot and a peripheral surface; and a male sheet comprising a tab and a peripheral surface, the male sheet being coupled to the female sheet by the tab, wherein the tab comprises: (i) a first stop element; (ii) an upper surface; (iii) a front surface; and (iv) a guiding surface;

wherein the first stop element is in an upper part of the male sheet closest to the peripheral surface of the female sheet;

wherein the upper surface of the tab extends upward from the first stop element, the upper surface of the tab defining an upward chamfer, a flat surface and a downward chamfer extending to the front surface of the tab;

wherein the front surface of the tab extends downward and is completed with a lower surface connected to the guiding surface of the tab;

wherein the female sheet comprises a second stop element defined by a lower flat surface of the female sheet on which the guiding surface of the tab of the male sheet is supported; and wherein the slot of the female sheet defines a through hole in the female sheet, the through hole being prismatic-shaped for coupling with the tab of the male sheet.

2. The device according to claim 1, wherein the guiding surface of the tab comprises an inclination, relative to the front surface of the tab, ranging between 0° and 30° until the guiding surface of the tab fits with the second stop element.

3. The device according to claim 1, wherein the guiding surface of the tab comprises an inclination, relative to the front surface of the tab, ranging between 31° and 60° until the guiding surface of the tab fits with the second stop element.

4. The device according to claim 1, wherein the front surface of the tab of the male sheet is shorter than the slot of the female sheet.

5. A method for connecting parts of a crate with the device according to claim 1, the method comprising:

a first movement in a perpendicular direction to an external side of the female sheet and oriented towards the peripheral surface of the male sheet, until the peripheral surface of the male sheet faces and is in contact with the female sheet, so as to make the first stop element of the male sheet face an upper horizontal surface of the female sheet adjacent to the slot; and a second movement in a parallel direction to the external side of the female sheet and oriented towards the first stop element and the second stop element, so as to make the upper horizontal surface of the female sheet adjacent to the slot face and coincide with the first stop element of the male sheet, and make the guiding surface of the tab of the male sheet face and coincide with the second stop element of the female sheet.

6. The method according to claim 5, wherein the second movement is applied by a mechanical action.

7. The method according to claim 5, wherein the second movement is applied by a guiding action resulting from geometry of the tab of the male sheet.

* * * * *